US012631097B2

(12) United States Patent
Brown et al.

(10) Patent No.: US 12,631,097 B2
(45) Date of Patent: May 19, 2026

(54) DOWNHOLE PUMP FLUID THROTTLING DEVICE

(71) Applicant: Halliburton Energy Services, Inc., Houston, TX (US)

(72) Inventors: Donn Jason Brown, Broken Arrow, OK (US); Ketankumar Kantilal Sheth, Tulsa, OK (US); Dezhi Zheng, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/970,904

(22) Filed: Oct. 21, 2022

(65) Prior Publication Data

US 2024/0133277 A1 Apr. 25, 2024
US 2024/0229623 A9 Jul. 11, 2024

(51) Int. Cl.
*E21B 43/12* (2006.01)
*E21B 34/06* (2006.01)

(52) U.S. Cl.
CPC ..... *E21B 43/128* (2013.01); *E21B 34/066* (2013.01); *E21B 2200/02* (2020.05)

(58) Field of Classification Search
CPC .. E21B 43/128; E21B 34/066; E21B 2200/02; E21B 43/121; E21B 43/122
See application file for complete search history.

(56) References Cited

U.S. PATENT DOCUMENTS 3,545,541 A * 12/1970 Douwe ..... E21B 23/12 166/368
4,624,310 A * 11/1986 Echols ..... E21B 34/102 166/321
11,319,786 B2 * 5/2022 Brown ..... F04B 53/06
2004/0244988 A1 * 12/2004 Preston ..... E21B 43/12 166/105.5
2008/0236821 A1 10/2008 Fielder
2010/0108307 A1 * 5/2010 Brown ..... E21B 43/124 166/105.5
2013/0199791 A1 * 8/2013 Hill, Jr. ..... E21B 34/06 166/332.8
2016/0177684 A1 6/2016 Parks et al.
2018/0128088 A1 5/2018 Pavlov et al.
2018/0274344 A1 9/2018 Ejim et al.
2019/0048886 A1 * 2/2019 Reed ..... F04D 13/10
2019/0234178 A1 * 8/2019 Panda ..... B23H 9/00
2019/0360302 A1 * 11/2019 Nowitzki ..... F16K 3/085
2021/0246894 A1 * 8/2021 Mollatt ..... F04B 43/1136
2021/0363998 A1 * 11/2021 Brown ..... F04D 15/0005
2022/0034165 A1 * 2/2022 Espinoza ..... E21B 34/10
2023/0018892 A1 * 1/2023 Chouzenoux ..... E21B 34/14
2023/0019875 A1 * 1/2023 Brown ..... E21B 49/087

OTHER PUBLICATIONS

"PCT Application No. PCT/US2023/069913, International Search Report and Written Opinion", Oct. 23, 2023, 11 pages.

* cited by examiner

*Primary Examiner* — Neel Girish Patel
(74) *Attorney, Agent, or Firm* — DeLizio, Peacock, Lewin & Guerra LLP

(57) ABSTRACT

In some embodiments, a method for controlling fluid flow through a downhole pump system in a borehole includes moving, via a downhole pump residing below a tubular in the borehole, a first fluid through the tubular, wherein the first fluid includes a compressible fluid. The method may further include increasing an intake pressure of the downhole pump while the first fluid is moving via a control valve system comprising a throttling valve.

20 Claims, 7 Drawing Sheets

DOWNHOLE PUMP FLUID THROTTLING DEVICE

TECHNICAL FIELD

The disclosure generally relates to wellbores formed in subsurface formations, and in particular, artificial lift systems used to extract hydrocarbons from subsurface formations.

BACKGROUND

In various oil field artificial lift applications, downhole pump systems such as electronic submersible pump (ESP) systems or progressive cavity pump (PCP) systems may be used to lift production fluid from partially depleted reservoirs to the surface. Adjustments to a flow rate through the pump and production system are typically done by throttling a choke or similar orifice at the surface. This throttling of the system is performed at the surface with a valve or series of valves. This operation (and its effect on the pump) is nonlinear in the actual control of the system, where the actual distance from a throttling valve to the pump discharge may be separated by several thousand feet. The fluids being produced through the production tubing, which is being controlled by a surface valve, may contain both compressible fluid (gas) and non-compressible fluid (liquid). Therefore, control of the pump system by the surface valve may experience a delayed effect on the pump performance. Additionally, gas within the produced fluids may compress, creating an elastic or accordion effect on the actual pump output. Hence, there is a need for techniques that facilitate near-instantaneous pump output performance in response to control inputs to the pump system.

BRIEF DESCRIPTION OF THE DRAWINGS

Embodiments of the disclosure may be better understood by referencing the accompanying drawings.

DESCRIPTION OF EMBODIMENTS

Overview

Downhole pump systems, such as those described below, may be utilized in the oil field to pump fluid to the surface when the natural pressure of a reservoir may no longer do so. One such pump system may comprise an electronic submersible pump (ESP) which may be powered by equipment at the surface and may contain a permanent magnet motor which drives a series of impellers to convey fluid through the pump and to a production tubing. ESPs may be designed primarily for pumping liquid. In the subsurface, fluid produced from subsurface formations may comprise water or various hydrocarbons. The hydrocarbons may comprise compressible fluids which may be compressed (or potentially change state) at higher pressures and may expand at lower pressures. For example, crude oil within a subsurface reservoir may comprise natural gas dissolved in solution within the oil. Above a bubble-point pressure (the pressure at which vapors begins to emerge from solution), the natural gas may remain in solution. The resulting fluid may appear and move as a liquid. However, as the oil is produced from the reservoir to the surface (or as a result of reservoir depletion over time), pressure and temperature fluctuations may cause the dissolved gas to fall below the bubble-point pressure and come out of solution as free gas. This free gas, at high enough quantities, may induce gas-locking of the ESP or similar downhole pump. This may cause a plethora of issues that affect the performance of the pump and may damage the pump itself. Thus, the downhole pump flow control system described herein may be utilized to throttle a flow rate through an ESP, PCP, or similar system and induce a pressure increase at the intake of the pump, thereby compressing the compressible fluids to remain in solution. This system may have the added benefit of increased operative control, as enacting flow control measures at the pump discharge rather than a valve at the surface may eliminate delay caused by compressible fluid effects along the length of the production tubing. This delay may be referred to as an "accordion effect".

Example Flow Control System

Figure 1:
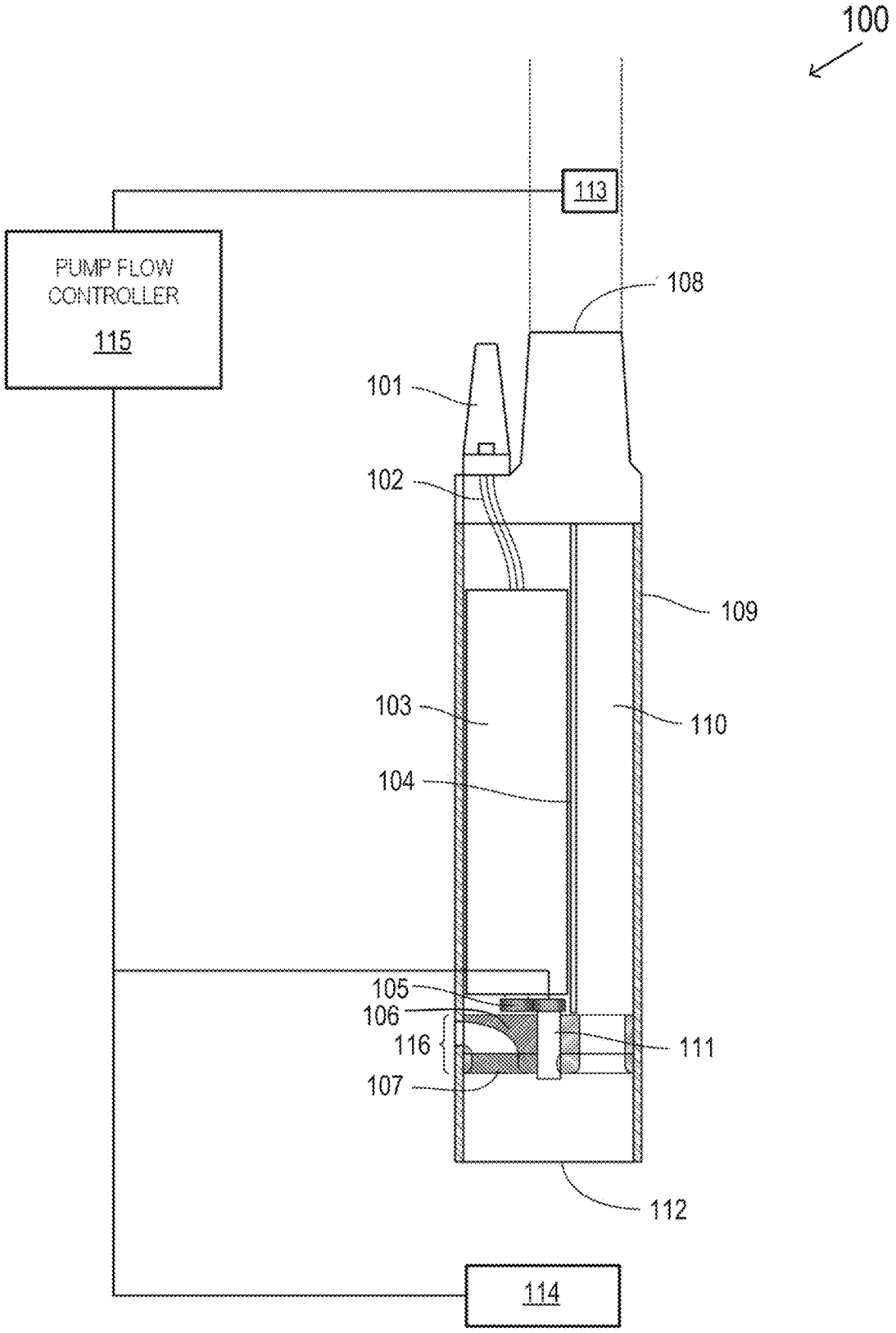
FIG. 1 depicts a cross-sectional view of an exemplary pump flow control system, according to some embodiments.

Some embodiments may be used in downhole flow control applications to control fluid flow output from a downhole pump system, such as an ESP or PCP system. Controlling or throttling fluid flow at the output of the pump may influence an intake pressure of the pump, and the intake pressure may affect a compressible fluid flowing through the pump. An example application for pump flow control via a downhole fluid flow control system is now described, although other types of applications are possible with the described configuration. In particular, FIG. 1 depicts an example flow control tool configuration attached to the outlet (top) of a downhole pump (an ESP) in which a plurality of perforated disks, a pump flow controller, and an actuator system may alter fluid flow through the downhole pump, according to some embodiments. A Pump Flow Control System 100 may be suited to address issues posed during operation of the downhole pump in which compressible fluids may affect the performance of the downhole pump.

FIG. 1 depicts a cross-sectional view of an exemplary pump flow control tool, according to some embodiments. In FIG. 1, a pump flow control system 100 may be situated atop or proximate to a downhole pump 114 disposed in a borehole. In some embodiments, the downhole pump 114 may be an electric submersible pump (ESP), as depicted in FIG. 1. In other embodiments, the downhole pump 114 may comprise a progressive cavity pump system or similar downhole pump system suitable for artificial lift operations. The pump flow control system 100 may attach to the outlet of the downhole pump 114 at a connection point 112. The pump flow control system 100 may be powered via a generator at the surface or a similar device to supply power. In some embodiments, the pump flow control system 100 may be powered by the same power source providing power to the downhole pump 114. Power may be routed into the pump flow control system 100 through a surface power connection 101. A power cable 102 on the inside of pump flow control system 100 may further route power from the surface power connection 101 to an actuator housing 103. The actuator housing 103 may reside in a dry chamber separate from a normal operation flow path 110 in which fluids may be conveyed from the subsurface to the surface or vice-versa. Both the actuator housing 103 and the normal operation flow path 110 may reside within a tool housing 109. The actuator housing 103 may be separated from the normal operation flow path 110 via an actuator isolation chamber wall 104. In some embodiments, the actuator housing 103 may include a lubricating fluid to lubricate internal components (e.g., as part of a motor) within the housing.

In some embodiments, the actuator housing 103 may include a motorized actuator or other motorized components powered via the power cable 102 and surface power connection 101 to actuate a plurality of gears situated below. For example, an actuator gear system 105 may convert mechanical energy generated by an actuator within the actuator housing 103 into rotational movement to drive an actuator drive shaft 111 which may move one or more disks. The one or more disks may be mechanically connected or proximate to the actuator gear system 105 via the actuator drive shaft 111. In some embodiments, the actuator housing 103 may comprise a hydraulic actuator which may be actuated via a hydraulic line (not shown) controlled at the surface. However, the actuator housing may similarly comprise a linear actuator, a rotary actuator, an electrical actuator (activated via an electrical line to the surface), a magnetic actuator, a cable-driven actuator, or any similar system which may perform its essential functions and survive in the subsurface environment. A control valve system 116 may comprise a fixed perforated upper disk 106 ("fixed disk") which may be situated below the actuator gear system 105, and a rotatable perforated lower disk 107 ("rotatable disk") may be installed longitudinally adjacent to or below the fixed disk 106. The fixed disk 106 and rotatable disk 107 may be comprised of a hardened material such as carbide or similarly comprised of a carbide alloy (e.g., Silicon Carbide, Tungsten Carbide, etc.). In some embodiments, the disks may also be comprised of a ceramic material. The fixed disk 106 and rotatable disk 107 may act as rotary valve system to control/throttle flow at the discharge of the downhole pump 114. In some embodiments, the pump flow control system 100 may utilize other throttling valve systems for the control valve system 116. For example, the control valve system 116 may comprise a linear valve actuated via the actuator (of various types) within the actuator housing 103. In some embodiments, different types of internal valve systems such as a globe, gate, ball, diverter, bulk material type valves, or any combination thereof may also be used in the control valve system 116.

In some embodiments, a pump flow controller 115 may be electronically coupled to the actuator gear system 105 to control a position of the rotatable disk 107. The pump flow controller 115 may further be electronically coupled to one or more sensors 113 and to the downhole pump 114. The one or more sensors 113 may collect data such as flow rate, fluid composition, pressure, temperature, etc. of a downhole fluid traveling through the pump flow control system 100 and the downhole pump 114. The sensors 113 may send the collected data to the pump flow controller 115 or to the surface via a wired connection. In some embodiments, the data also may be relayed from the pump flow controller 115 to the surface via one or more cables. In some embodiments, the pump flow controller 115 may send the data to communication equipment at the surface. The data may further be transmitted from the communication equipment to a receiver elsewhere to enable remote flow control operations of the pump.

The sensors 113 may be located inside a tubular which may connect to the pump flow control system 100 at a production tubing connection 108. In some embodiments, the one or more sensors 113 also may collect data at an intake of the downhole pump 114 to measure a pump intake pressure. In some embodiments, the sensors 113 may be located at any suitable location within or external to the pump flow control system 100.

The pump flow controller 115 may be configured to receive instructions (e.g., control inputs) from the surface and implement the instructions to the downhole pump 114, the actuator gear system 105, or both. For example, if the sensors 113 collect information indicative of gas formation (i.e., gas coming out of solution) within the fluid at the intake or within the downhole pump 114, an operator may send a command to the pump flow controller 115 to actuate the actuator gear system 105 to rotate the rotatable disk 107. Rotating the rotatable disk 107 to disrupt a flow pathway formed between perforations of the fixed disk 106 and rotatable disk 107 may reduce a flow rate at the output of the downhole pump 114 (at connection point 112). Reduction of the flow rate may induce a backpressure within the downhole pump 114 and may increase an intake pressure of the downhole pump 114. The increased intake pressure at the intake of the downhole pump 114 may force free gas back into solution and mitigate gas locking of the downhole pump 114.

Figure 2A:
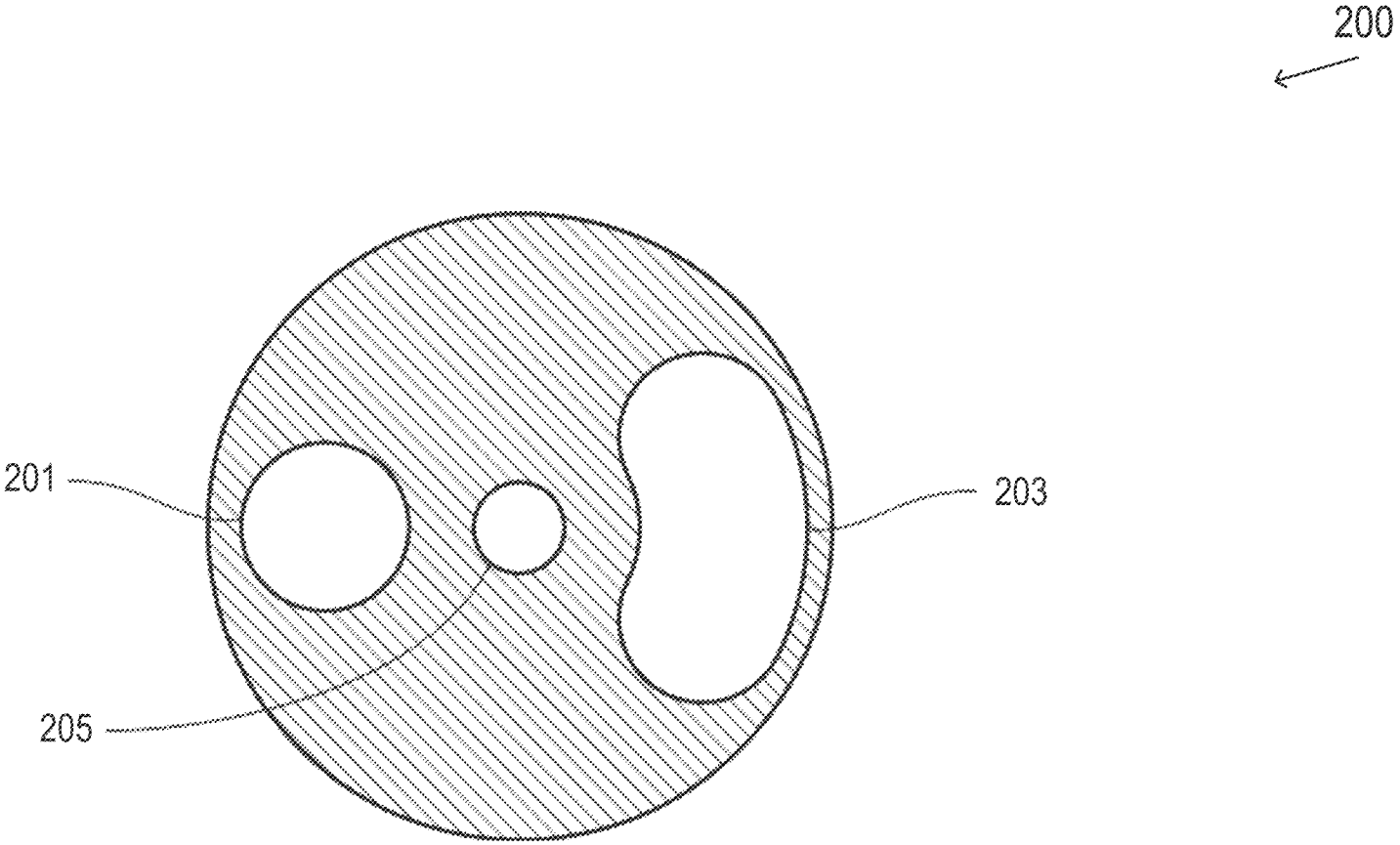
FIG. 2A depicts a bottom view of an example fixed perforated disk, according to some embodiments

The fixed disk 106 and rotatable disk 107 of FIG. 1 may comprise one or more perforations to allow fluid passage to the normal operation flow path 110. FIG. 2A depicts a bottom view of an example fixed disk, according to some embodiments.

A fixed disk 200 may comprise multiple perforations such as a vent perforation 201 and a flow perforation 203. In some embodiments, the vent perforation 201 leads to a check valve within the pump flow control system 100 to vent fluid to the wellbore, if necessary. The flow perforation 203 may lead into the normal operation flow path 110 of FIG. 1, where fluids may travel through the pump flow control system 100 to the production tubing. A passage 205 may allow the actuator drive shaft 111 of FIG. 1 to pass through the fixed disk 200 without inducing movement of the fixed disk 200.

Figure 2B:
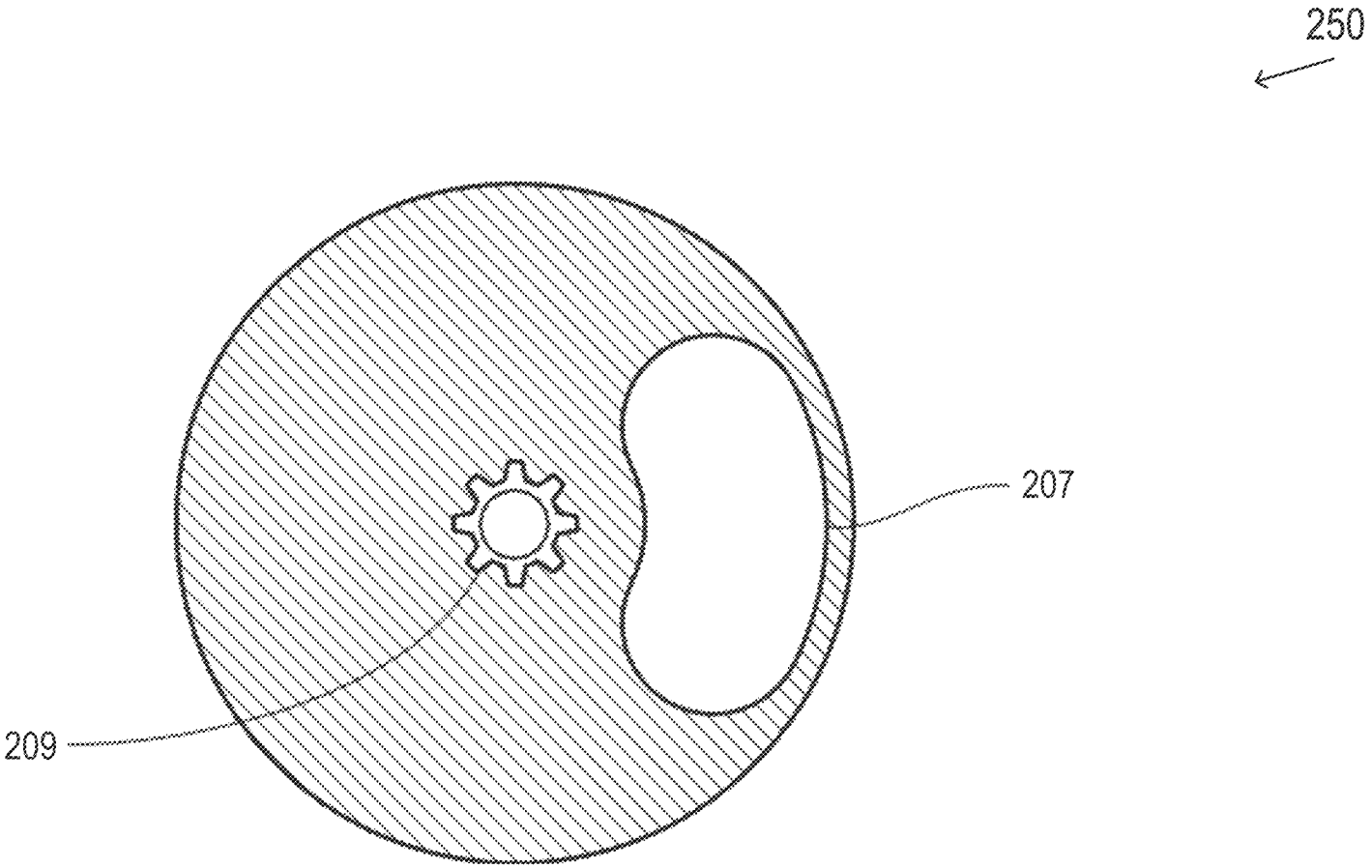
FIG. 2B depicts a bottom view of an example rotatable perforated disk, according to some embodiments

FIG. 2B depicts a bottom view of an example rotatable disk, according to some embodiments. The rotatable disk 250 may comprise a gear 209 coupled to the actuator drive shaft 111 of FIG. 1, which may be coupled to the actuator gear system 105. When activated, the gear 209 may rotate the rotatable disk 250 to position a flow perforation 207 where desired. For example, to increase the intake pressure of the downhole pump 114, an operator may position the rotatable disk 250 in such a way that flow perforation 207 is misaligned with the flow perforation 203 of FIG. 2A. Thus, a flow area created between the two longitudinally adjacent disks may reduce in size, lowering a flow rate through the pump flow control system 100 and increasing the intake pressure of the downhole pump 114.

Example Flow Passage Configurations

Figure 3A:
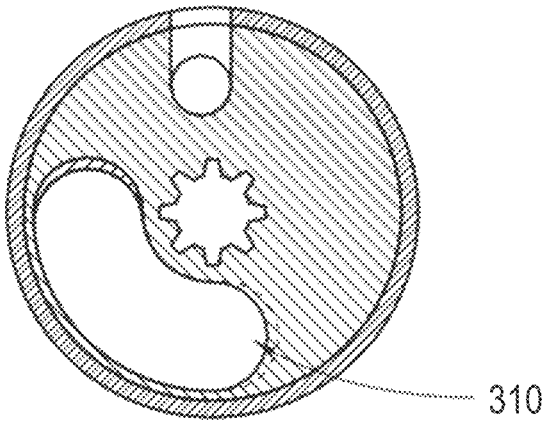
FIGS. 3A-3C depict example flow passage configurations, according to some embodiments.
Figure 3B:
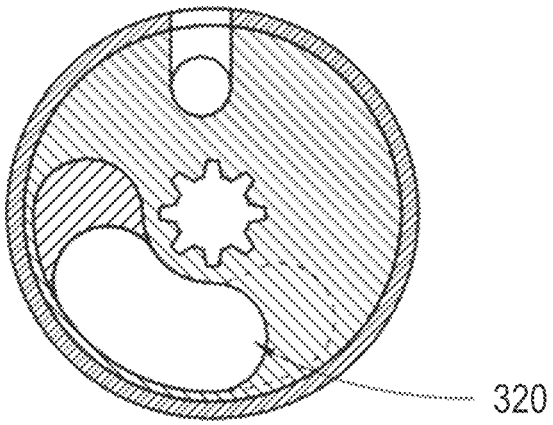
Figure 3C:
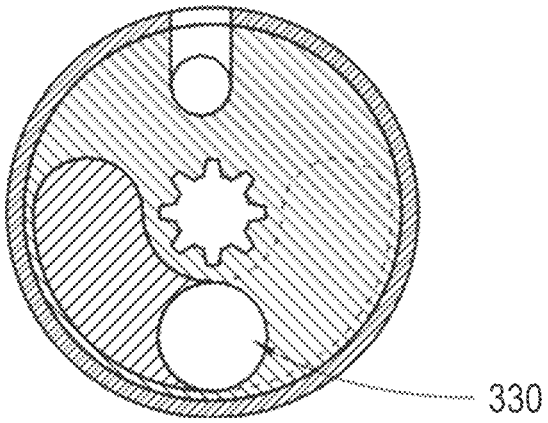

As described above, reducing the flow area between the fixed disk 200 and rotatable disk 250 may increase the intake pressure of the downhole pump 114. FIGS. 3A-C depict three exemplary flow passage configurations, according to some embodiments. The flow passage configurations are formed by an overlap of the flow perforations 203 and 207 of FIGS. 2A and 2B, respectively. FIG. 3A depicts a first example flow passage configuration, according to some embodiments. An open flow passage 310 may be formed by a near-exact overlap of flow perforation 203 of the fixed disk 200 and flow perforation 207 of the rotatable disk 250. This configuration may facilitate maximum fluid flow from the outlet (i.e., discharge) of the downhole pump 114 to the production tubing.

FIG. 3B depicts a second example flow passage configuration, according to some embodiments. A minorly-occluded flow passage 320 is formed when the rotatable disk 250 is rotated to form a slight misalignment between the flow perforations 203 and 207. The flow passage 320 creates a smaller flow area for fluid to travel than that of FIG. 3A, and this configuration may induce increased intake pressure at the intake of the downhole pump 114.

FIG. 3C depicts a third example flow passage configuration, according to some embodiments. A significantly occluded flow passage 330 is formed when the rotatable disk 250 is rotated to substantially misalign the flow perforations 203 and 207. The flow passage 330 creates a smaller flow area for fluid to travel than that of either FIG. 3A or FIG. 3B, and this configuration may induce a larger increase in intake pressure at the intake of the downhole pump 114. The three example flow passage configurations 310-330 depict example positions of the rotatable disk 107; however, the rotatable disk 107 and resulting flow passage configurations are not limited to the three example configurations. The rotatable disk 107 and fixed disk 106 may be oriented to induce any desired flow and any desired intake pressure. For example, in some embodiments, the rotatable disk 107 may completely misalign with the fixed disk 106, halting flow to the production tubing.

Example Flow Control Operation

Figure 4:
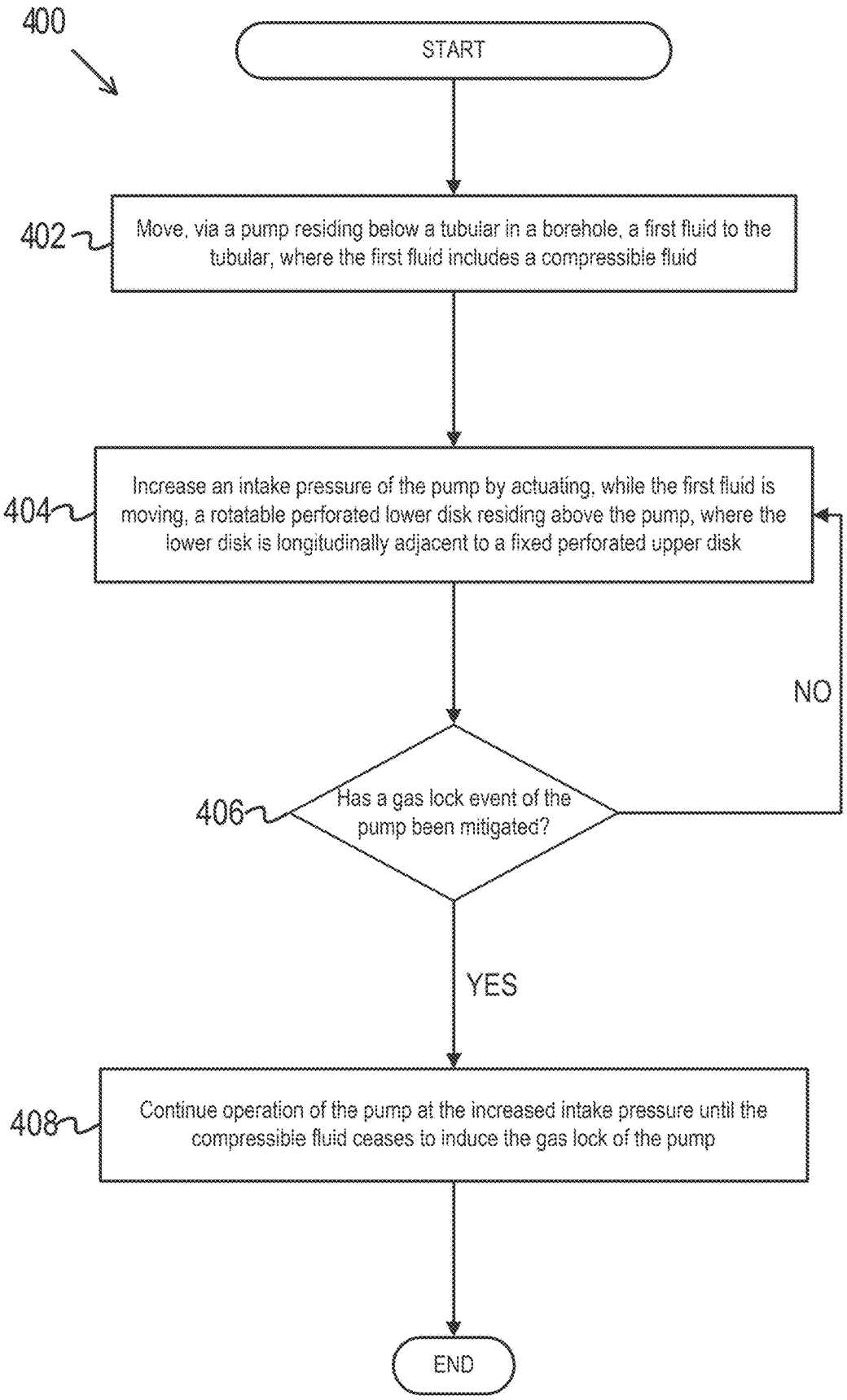
FIG. 4 depicts a flowchart of example operations for intake pressure management of a downhole pump, according to some embodiments

Example operation of the pump flow control system 100 is now described. FIG. 4 depicts a flowchart of example operations for intake pressure management of a downhole pump, according to some embodiments. Operations of a flowchart 400 may be performed by software, firmware, hardware, or a combination thereof. Such operations are described with reference to the systems of FIGS. 1-3. However, such operations may be performed by other systems or components. For example, some of the operations may be performed by a computer within or external to the pump flow control system. The operations of the flowchart 400 start at block 402.

At block 402, a first fluid is moved to a tubular via a pump residing below the tubular in a borehole, where the first fluid includes a compressible fluid. For example, with reference to FIG. 1, a first fluid is moved to a production tubing coupled to the pump flow control system 100 at production tubing connection 108. The downhole pump 114 may reside below the production tubing and pump flow control system 100. The downhole pump 114 may utilize a plurality of impellers to bring the compressible fluid from the intake (not shown) of the downhole pump 114 to the pump flow control system 100 above.

At block 404, an intake pressure of the pump may be increased by actuating, while the first fluid is moving, a rotatable perforated lower disk residing above the pump, where the lower disk is longitudinally adjacent to a fixed perforated upper disk. For example, with reference to FIG. 1, the rotatable disk 107 situated below the fixed disk 106 may be positioned by an actuator driving the actuator gear system 105. With additional reference to FIGS. 2A, 2B, 3B and 3C, the fixed disk 200 and rotatable disk 250 may form an obstructed flow passage (320, 330, or otherwise) through a misalignment between said disks, reducing a flow area between flow perforations 203 and 207. The reduced flow area may lower a flow rate to the normal operation flow path 110. The reduced flow rate may increase the intake pressure of the downhole pump 114, and positioning the pump flow control system 100 at the discharge of the downhole pump 114 rather than the surface would allow an operator to derive instant results in flow adjustment for issues like gas handling, throttling of flow, sand fall back during a shutdown event of the downhole pump 114, etc. Because the first fluid comprises a compressible fluid, the restriction of flow at the discharge of the downhole pump 114 (rather than at the surface) may enact immediate effects on the fluid, mitigating the accordion effect along the length of the production tubing and/or wellbore.

At block 406, a decision is made to determine whether a gas lock event of the pump has been mitigated. For example, with reference to FIG. 1, the one or more sensors 113 may relay data to the pump flow controller 115 regarding operational data of the downhole pump 114. The data may include the pump speed, drive motor torque (if applicable), the intake pressure of the downhole pump 114, etc. Gas locking of a downhole pump (particularly an ESP) may occur when a large enough volume of gas (i.e., a gas slug) accumulates within the pump to essentially halt fluid production through the pump. This may result in fluid production losses or may damage the pump (or the drive motor within the pump). Bearings within the pump, if applicable, may depend upon continuous fluid flow for cooling, and interruption of said flow during a gas lock event may prove harmful. Adjusting the pump speed of the downhole pump may move gas slugs through the pump quicker and may draw liquid from the reservoir to the pump intake, but operational control during gas lock events may still prove very limited. Thus, the pump flow control system depicted in FIG. 1 may allow for increased operational responsiveness; the pump speed may be altered, as well as the intake pressure of the pump through downhole flow rate modulation. In some embodiments, a decision on whether to alter the pump speed, intake pressure of the downhole pump, or both may further depend on other conditions in the well.

As previously discussed, the intake pressure of the downhole pump may be increased by a decreasing a flow rate at the discharge of the pump. Backpressure from the reduced flow rate may increase the intake pressure, which may result in "compressing" compressible fluids at the pump intake. Throttling back the flow rate via the rotatable disk and actuator gear system (rotatable disk 107 and actuator gear system 105 of FIG. 1, respectively) while the fluid is moving may induce this intake pressure increase. The increase in intake pressure at the pump intake may force some of the free gas in the wellbore back into solution within liquid below the pump 114. If it is determined that the gas lock event of the pump has been mitigated, flow progresses to block 408. For example, with reference to FIG. 1, if the one or more sensors 113 provide data to the pump flow controller 115 which are indicative that a gas lock event has been mitigated, the operations of flowchart 400 progress to block 408. If the gas lock event has not been effectively mitigated, flow returns to block 406 where the intake pressure of the pump may be increased further. For example, with reference to FIGS. 2-3, the rotatable disk 250 may be actuated from a position which forms flow passage 320 to a position which forms flow passage 330. The reduced flow area may further increase the intake pressure of the pump to mitigate gas locking.

At block 408, operation of the pump is continued at the increased intake pressure until the compressible fluid ceases to induce the gas locking of the pump. For example, with reference to FIG. 1, the downhole pump 114 may continue operation at an increased intake pressure created by actuation of the rotatable disk 107. The downhole pump 114 may operate at the increased intake pressure until the pump flow controller 115 or an operator at the surface determines that a gas lock event of the downhole pump 114 has been successfully mitigated. In some embodiments, the downhole pump 114 may continue to operate at the increased intake pressure. In other embodiments, the pump flow control system 100 may open flow to the production tubing to prevent production losses. The pump flow control system 100 may decrease the intake pressure of the downhole pump 114 by moving the rotatable disk to a flow passage configuration similar to the flow passage 310 of FIG. 3A. In this configuration, with reference to FIG. 1, the fixed disk 106 and rotatable disk 107 may be aligned to permit near-unrestricted fluid flow to the normal operation flow path 110.

Example Computer

Figure 5:
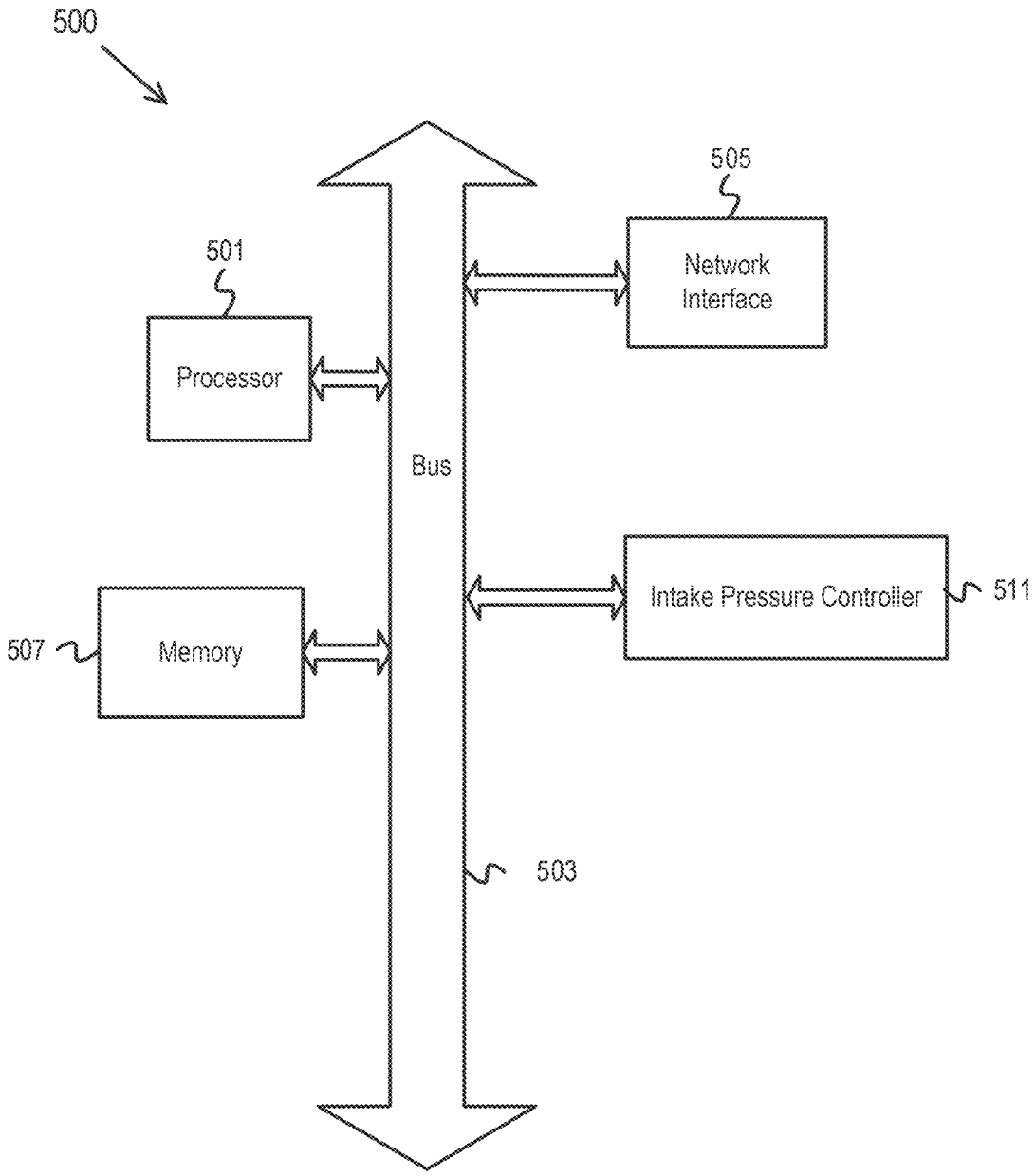
FIG. 5 depicts an example computer, according to some embodiments.

Embodiments of the exemplary pump flow control system may be used in conjunction with an example computer, as described in FIG. 5. A computer 500 system includes a processor 501 (possibly including multiple processors, multiple cores, multiple nodes, and/or implementing multi-threading, etc.). The computer 500 includes a memory 507. The memory 507 may be system memory or any one or more of the above already described possible realizations of machine-readable media. The computer 500 also includes a bus 503 and a network interface 505. The computer 500 may communicate via transmissions to and/or from remote devices via the network interface 505 in accordance with a network protocol corresponding to the type of network interface, whether wired or wireless and depending upon the carrying medium. In addition, a communication or transmission may involve other layers of a communication protocol and or communication protocol suites (e.g., transmission control protocol, Internet Protocol, user datagram protocol, virtual private network protocols, etc.).

The computer 500 also includes an intake pressure controller 511. The intake pressure controller 511 may perform one or more of the operations described herein. Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, signal processor cards, etc.). The processor 501 and the network interface 505 are coupled to the bus 503. Although illustrated as being coupled to the bus 503, the memory 507 may be coupled to the processor 501.

While the aspects of the disclosure are described with reference to various implementations and exploitations, it will be understood that these aspects are illustrative and that the scope of the claims is not limited to them. In general, techniques for well logging as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Applications

Figure 6:
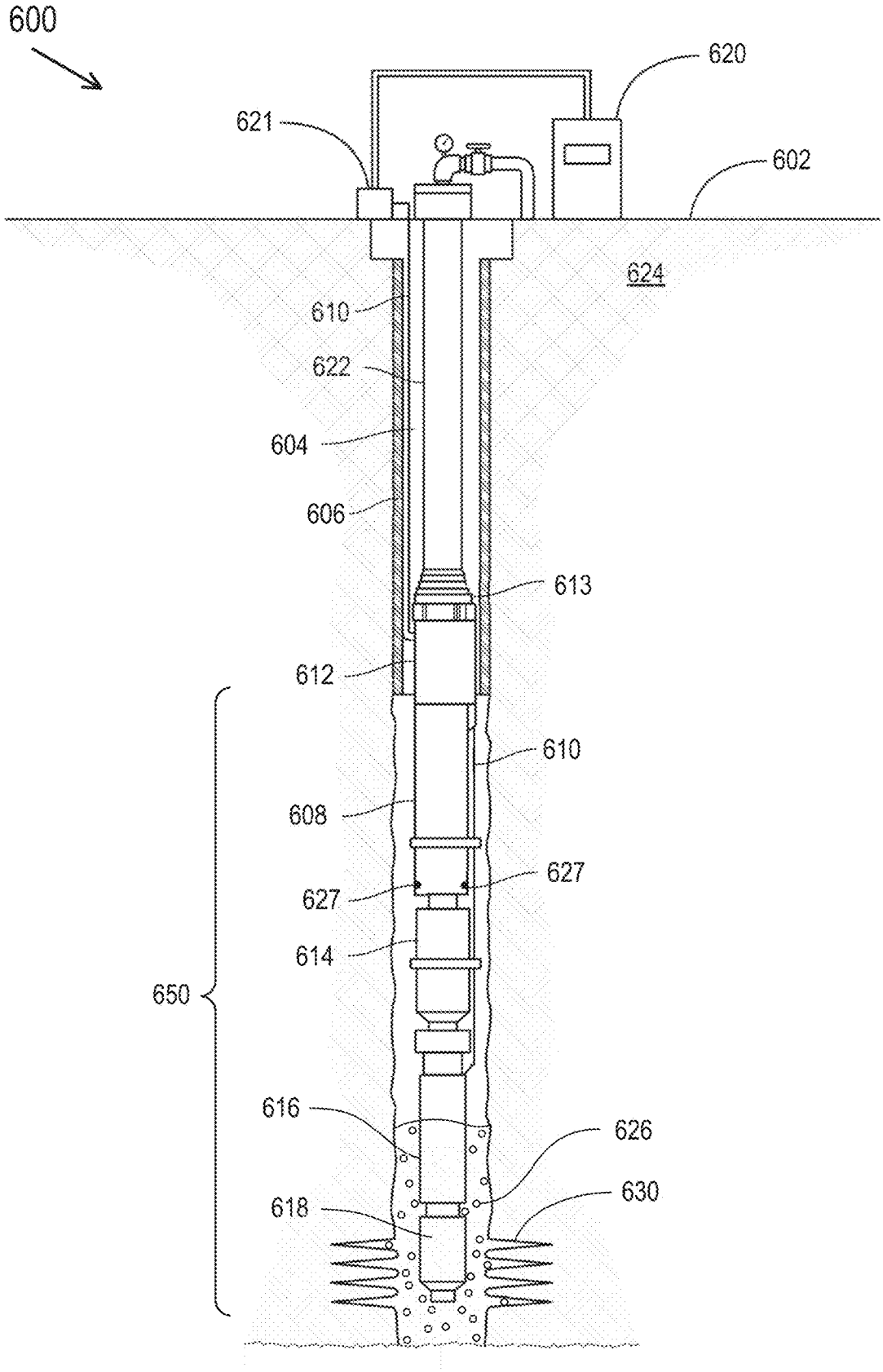
FIG. 6 depicts an example well system, according to some embodiments.

FIG. 6 illustrates one embodiment of an example well system 600 for hydrocarbon reservoir production according to one or more aspects of the present disclosure. While well system 600 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

In one or more embodiments, well system 600 comprises a wellbore 604 below a surface 602 in a formation 624. In one or more embodiments, wellbore 604 may comprise a vertical, deviated, horizontal, or any other type of wellbore. Wellbore 604 may be defined in part by a casing 606 that may extend from a surface 602 to a selected downhole location. Portions of wellbore 604 that do not comprise the casing 606 may be referred to as open hole.

In one or more embodiments, various types of hydrocarbons or fluids may be pumped from wellbore 604 to the surface 602 using a pump system 650 disposed or positioned downhole, for example, within, partially within, or outside casing 606 of wellbore 604. In one or more embodiments, pump system 650 may comprise an electrical submersible pump (ESP) system. Pump system 650 may comprise a pump 608, an electrical cable 610, a pump flow control system 612, a seal or equalizer 614, a motor 616, and a sensor 618. The pump 608 may be an ESP, including but not limited to, a multi-stage centrifugal pump, a rod pump, a progressive cavity pump, any other suitable pump system or combination thereof. The pump 608 may transfer pressure to the fluid 626 or any other type of downhole fluid to propel the fluid from downhole to the surface 602 at a desired or selected pumping rate. In one or more embodiments, pump 608 may be coupled to a pump flow control system 612 comprising a housing 613. Motor 616 may, in some embodiments, be a permanent magnet motor (PMM) or a comparable motor to drive the pump 608 and may be coupled to at least a downhole sensor 618. In one or more embodiments, the electrical cable 610 is coupled to the motor 616 and to controller 620 at the surface 602. The electrical cable 610 may provide power to the motor 616, transmit one or more control or operation instructions from controller 620 to the motor 616, or both. The electrical cable 610 may be communicatively coupled to the controller 620 and also to a flowmeter 621 disposed at the surface 602. Without limitations, the flowmeter 621 may be replaced with any suitable sensor utilized to measure a parameter of the fluid 626.

In one or more embodiments, fluid 626 may be a multiphase wellbore fluid comprising one or more hydrocarbons. For example, fluid 626 may be a two-phase fluid that comprises a gas phase and a liquid phase from a wellbore or reservoir in the formation 124. In one or more embodiments, fluid 626 may enter the wellbore 604, casing 606 or both through one or more perforations in the formation 624 and flow uphole to one or more intake ports 627 of the pump system 650, wherein the one or more intake ports 627 are disposed at a distal end of the pump 608. The pump 608 may transfer pressure to the fluid 626 by adding kinetic energy to the fluid 626 via centrifugal force and converting the kinetic energy to potential energy in the form of pressure. In one or more embodiments, pump 608 lifts fluid 626 to the surface 602.

In one or more embodiments, motor 616 may consist of an electrical submersible motor configured or operated to turn pump 608 and may, for example, be a two or more-pole, three-phase squirrel cage induction motor or a permanent magnet motor (PMM). However, other motor configurations may be possible. In one or more embodiments, a production tubing section 622 may couple to the pump 608 using one or more connectors 628 or may couple directly to the pump 608. In one or more embodiments, any one or more production tubing sections 622 may be coupled together to extend the pump system 650 into the wellbore 604 to a desired or specified location. Any one or more components of fluid 626 may be pumped from pump 608 through production tubing 622 to the surface 602 for transfer to a storage tank, a pipeline, transportation vehicle, any other storage, distribution or transportation system and any combination thereof. In some embodiments, the pump flow control system 612 may include a fixed perforated disk and a rotatable perforated disk. During operations, the rotatable disk may be positioned to substantially throttle or halt the flow of fluid through the pump flow control system 612. If gas is present with the fluid 626, a reduced flow rate will increase the intake pressure at the bottom of the pump 608. The increased intake pressure may force the fluid 626 to flow in the liquid phase, despite a presence of dissolved gas within. This may improve the performance of the pump 608 and reduce an incidence rate of gas-lock events. Additionally, reducing the flow rate at the pump flow control system 612 may deliver near-instant results, whereas a significant delay between action and effects may be seen through flow rate reductions initiated by valves at the surface 602, or by pump speed changes to the pump 608.

EXAMPLE EMBODIMENTS

Embodiment #1: A method for controlling fluid flow through a downhole pump system in a borehole, comprising: moving, via a downhole pump residing below a tubular in the borehole, a first fluid through the tubular, wherein the first fluid includes a compressible fluid; and increasing an intake pressure of the downhole pump while the first fluid is moving via a control valve system comprising a throttling valve.

Embodiment #2: The method of Embodiment 1, wherein the first fluid moves through the control valve system.

Embodiment #3: The method of any one of Embodiments 1-2, wherein increasing the intake pressure of the downhole pump, while the first fluid is moving, compresses the compressible fluid to form compressed fluid.

Embodiment #4: The method of Embodiment 3, wherein the compressed fluid will not gas lock the downhole pump, wherein the downhole pump comprises an electric submersible pump (ESP) or a progressive cavity pump (PCP).

Embodiment #5: The method of any one of Embodiments 1-4, wherein increasing the intake pressure of the downhole pump includes: reducing a flow area through which the first fluid flows, wherein the flow area is formed by the throttling valve.

Embodiment #6: The method of any one of Embodiments 1-5, wherein increasing the intake pressure of the downhole pump includes: activating a gear system coupled with the throttling valve, wherein the throttling valve comprises a rotary valve, wherein the rotary valve comprises a rotatable perforated lower disk residing above the downhole pump and a fixed upper disk, wherein the lower disk is coupled longitudinally adjacently to the fixed upper disk, and wherein the gear system is to rotate the lower disk.

Embodiment #7: The method of Embodiment 6, wherein activating the gear system comprises activating an actuator, wherein the actuator comprises one of a linear actuator, a hydraulic actuator, a rotary actuator, an electric actuator, a magnetic actuator, and a cable-driven actuator.

Embodiment #8: A downhole flow control valve system positioned in a borehole comprising: a throttling valve; and an actuator configured to increase an intake pressure of a downhole pump hydraulically coupled with the throttling valve, wherein the throttling valve is to form a flow passage for a compressed fluid.

Embodiment #9: The downhole flow control valve system of Embodiment 8, wherein the downhole pump is an electric submersible pump (ESP) or a progressive cavity pump (PCP) configured to move the compressed fluid through the flow passage.

Embodiment #10: The downhole flow control valve system of any one of Embodiments 8-9, wherein the throttling valve comprises a rotary valve, wherein the rotary valve includes: a rotatable first disk including a first perforation; and a fixed second disk including a second perforation, wherein the second disk is longitudinally-adjacently coupled with the first disk such that at least a first portion of the first perforation overlaps the second perforation, wherein the overlap forms the flow passage.

Embodiment #11: The downhole flow control valve system of Embodiment 10, wherein the actuator is coupled to a gear system including at least one gear coupled with the first disk to rotate the first disk, and wherein the actuator comprises one of a linear actuator, a hydraulic actuator, a rotary actuator, an electric actuator, a magnetic actuator, and a cable-driven actuator.

Embodiment #12: The downhole flow control valve system of any one of Embodiments 10-11, wherein the overlap influences the intake pressure of the downhole pump.

Embodiment #13: The downhole flow control valve system of Embodiment 12, wherein reducing the overlap increases the intake pressure of the downhole pump.

Embodiment #14: The downhole flow control valve system of any one of Embodiments 10-13, further comprising a downhole pump controller and one or more sensors, the downhole pump controller configured to: receive, from the one or more sensors, data measuring attributes of the downhole pump, the downhole flow control valve system, the compressed fluid, and the borehole; and actuate, via the actuator, the first disk to control a flow rate through the flow passage.

Embodiment #15: A downhole flow control apparatus positioned in a borehole comprising: a throttling valve; and an actuator configured to increase an intake pressure of a downhole pump hydraulically coupled with the throttling valve, wherein the throttling valve is to form a flow passage for a compressed fluid.

Embodiment #16: The apparatus of Embodiment 15, wherein the downhole pump is an electric submersible pump (ESP) or a progressive cavity pump (PCP) configured to move the compressed fluid through the flow passage.

Embodiment #17: The apparatus of any one of Embodiments 15-16, wherein the throttling valve comprises a rotary valve, wherein the rotary valve includes: a rotatable first disk including a first perforation; and a fixed second disk including a second perforation, wherein the second disk is longitudinally-adjacently coupled with the first disk such that at least a first portion of the first perforation overlaps the second perforation, wherein the overlap forms the flow passage.

Embodiment #18: The apparatus of Embodiment 17, wherein the actuator is coupled to a gear system including at least one gear coupled with the first disk to rotate the first disk, and wherein the actuator comprises one of a linear actuator, a hydraulic actuator, a rotary actuator, an electric actuator, a magnetic actuator, and a cable-driven actuator.

Embodiment #19: The apparatus of any one of Embodiments 17-18, wherein reducing the overlap increases the intake pressure of the downhole pump.

Embodiment #20: The apparatus of any one of Embodiments 17-19, further comprising a downhole pump controller and one or more sensors, the downhole pump controller configured to: receive, from the one or more sensors, data measuring attributes of the downhole pump, the apparatus, the compressible fluid, and the borehole; and actuate, via the actuator, the first disk to control a flow rate through the flow passage.

What is claimed is:

1. A method for controlling fluid flow through a downhole pump system in a borehole comprising:

moving, via a downhole pump residing below a tubular in the borehole, a first fluid through the tubular, wherein the first fluid includes a compressible fluid; and rotating a rotatable perforated disk of a control valve system from a first position to a second position using a motorized actuator positioned up-hole of the control valve system, wherein actuating the rotatable perforated disk from the first position to the second position increases an intake pressure of the downhole pump while the first fluid is moving uphole, wherein the control valve system is configured to allow the uphole movement of at least a portion of the first fluid in both the first position and the second position of the rotatable perforated disk.

2. The method of claim 1, wherein the first fluid moves through the control valve system.

3. The method of claim 1, wherein increasing the intake pressure of the downhole pump, while the first fluid is moving, compresses the compressible fluid to form compressed fluid.

4. The method of claim 3, wherein the compressed fluid will not gas lock the downhole pump, wherein the downhole pump comprises an electric submersible pump (ESP) or a progressive cavity pump (PCP).

5. The method of claim 1, wherein increasing the intake pressure of the downhole pump includes:

reducing a flow area through which the first fluid flows, wherein the flow area is formed by at least the rotatable perforated disk and a fixed perforated disk of the control valve system.

6. The method of claim 1, wherein increasing the intake pressure of the downhole pump includes:

activating a gear system coupled with the control valve system, wherein the rotatable perforated disk is a rotatable perforated lower disk residing above the downhole pump, wherein the control valve system includes the rotatable perforated lower disk and a fixed upper disk, wherein the rotatable perforated lower disk is coupled longitudinally adjacently to the fixed upper disk, and wherein the gear system is to rotate the rotatable perforated lower disk.

7. The method of claim 6, wherein activating the gear system comprises activating the motorized actuator.

8. A system comprising:

a control valve system configured to couple with a downhole pump configured for placement in a borehole, wherein the control valve system includes a rotatable first disk having one or more first perforations; and a motorized actuator positioned up-hole of the control valve system and configured to increase an intake pressure of the downhole pump while the first fluid is moving uphole by rotating the rotatable first disk from a first position to a second position, wherein the control valve system is configured to allow an uphole movement of at least a portion of a compressible fluid in the borehole in both the first position and the second position of the rotatable first disk.

9. The system of claim 8, wherein the downhole pump is an electric submersible pump (ESP) or a progressive cavity pump (PCP) configured to move the compressible fluid.

10. The system of claim 8, wherein the control valve system includes:

a fixed second disk including one or more second perforations; and a flow passage for the compressible fluid in the borehole, wherein the fixed second disk is longitudinally-adjacently coupled with the rotatable first disk such that at least a first portion of the one or more first perforations overlaps the one or more second perforations, wherein the overlap forms the flow passage.

11. The system of claim 10, wherein the motorized actuator is coupled to a gear system including at least one gear coupled with the rotatable first disk to rotate the rotatable first disk.

12. The system of claim 10, wherein the overlap influences the intake pressure of the downhole pump.

13. The system of claim 12, wherein reducing the overlap increases the intake pressure of the downhole pump.

14. The system of claim 10, further comprising a downhole pump controller and one or more sensors, the downhole pump controller configured to:

receive, from the one or more sensors, data measuring attributes of at least one of the downhole pump, the control valve system, the compressed fluid, and the borehole; and actuate, via the motorized actuator, the rotatable first disk to control a flow rate through the flow passage.

15. An apparatus comprising:

a control valve system configured to couple with a downhole pump configured for placement in a borehole, wherein the control valve system includes a rotatable first disk having one or more first perforations; and a motorized actuator positioned up-hole of the control valve system and configured to increase an intake pressure of the downhole pump while the first fluid is moving uphole by rotating the rotatable first disk from a first position to a second position, wherein the control valve system is configured to allow an uphole movement of at least a portion of a compressible fluid in the borehole in both the first position and the second position of the rotatable first disk.

16. The apparatus of claim 15, wherein the downhole pump is an electric submersible pump (ESP) or a progressive cavity pump (PCP) configured to move the compressible fluid.

17. The apparatus of claim 15, wherein the control valve system includes:

a fixed second disk including one or more second perforations; and a flow passage for the compressible fluid in the borehole, wherein the fixed second disk is longitudinally-adjacently coupled with the first rotatable disk such that at least a first portion of the one or more first perforations overlaps the one or more second perforations, wherein the overlap forms the flow passage.

18. The apparatus of claim 17, wherein the motorized actuator is coupled to a gear system including at least one gear coupled with the first rotatable disk to rotate the first rotatable disk.

19. The apparatus of claim 17, wherein reducing the overlap increases the intake pressure of the downhole pump.

20. The apparatus of claim 17, further comprising a downhole pump controller and one or more sensors, the downhole pump controller configured to:

receive, from the one or more sensors, data measuring attributes of the downhole pump, the apparatus, the compressible fluid, and the borehole; and actuate, via the motorized actuator, the rotatable first disk to control a flow rate through the flow passage.

* * * * *